US005681021A

United States Patent [19]

Noll

[11] Patent Number: 5,681,021

[45] Date of Patent: Oct. 28, 1997

[54] ROOF JACK WITH BRACKET

[76] Inventor: Ronald C. Noll, 20749 University Blvd., Shaker Heights, Ohio 44122

[21] Appl. No.: 495,798

[22] Filed: Jun. 27, 1995

[51] Int. Cl.[6] ..... E01G 25/00

[52] U.S. Cl. ..... 248/357; 248/237; 248/300; 52/639; 52/640

[58] Field of Search ..... 248/300, 354.1, 248/357, 237; 29/239; 52/639, 640, 641, 712; 254/133 R, DIG. 1, DIG. 4, DIG. 5; 182/45

[56] References Cited

U.S. PATENT DOCUMENTS

| | | | |
|---|---|---|---|
| 132,922 | 11/1872 | Pharo . | |
| 573,452 | 12/1896 | Delahunt . | |
| 942,592 | 12/1909 | Schneider . | |
| 960,207 | 5/1910 | Slater . | |
| 1,472,992 | 11/1923 | Roeglin . | |
| 1,478,682 | 12/1923 | Stansberry | 182/45 |
| 1,743,371 | 1/1930 | Montag | 182/45 |
| 1,886,921 | 11/1932 | Tobin | 182/45 X |
| 2,183,015 | 12/1939 | Foulds | 52/640 X |
| 2,638,386 | 5/1953 | Larson | 248/357 X |
| 3,125,898 | 3/1964 | Maples et al. . | |
| 3,164,353 | 1/1965 | Rene | 182/45 X |
| 3,362,117 | 1/1968 | Van Raden | 52/640 X |
| 3,574,981 | 4/1971 | Henschen . | |
| 3,785,108 | 1/1974 | Satchell | 52/640 X |
| 4,019,765 | 4/1977 | Nichola . | |
| 4,192,406 | 3/1980 | Mitchell | 248/300 X |
| 4,221,363 | 9/1980 | Jasper | 248/354.4 X |
| 4,288,961 | 9/1981 | Snow, Jr. et al. . | |
| 4,371,139 | 2/1983 | Clark | 248/237 |
| 4,381,635 | 5/1983 | Solo | 52/639 |
| 4,520,649 | 6/1985 | Barton, Sr. | 254/DIG. 1 X |
| 4,583,712 | 4/1986 | Wilks . | |
| 4,676,044 | 6/1987 | Terenzoni . | |
| 4,709,897 | 12/1987 | Mooney | 248/300 X |
| 4,884,775 | 12/1989 | Fischer, Jr. | 248/237 |
| 4,946,123 | 8/1990 | Albert | 248/237 |
| 5,104,089 | 4/1992 | Shook et al. . | |
| 5,142,838 | 9/1992 | Simpson et al. | 52/640 |
| 5,217,317 | 6/1993 | Young | 52/712 X |
| 5,230,198 | 7/1993 | Callies | 52/712 X |

*Primary Examiner*—Alvin C. Chin-Shue
*Assistant Examiner*—Richard M. Smith
*Attorney, Agent, or Firm*—Pearne, Gordon, McCoy & Granger LLP

[57] ABSTRACT

A system for lifting and supporting a roof including a jack and a pair of jack mounting brackets. One of the mounting brackets is attached to a roof truss and the other of the mounting brackets is attached to a ceiling joist. The jack extends between the mounting brackets, and has reduced diameter ends which are received within enlarged openings in the mounting brackets.

7 Claims, 3 Drawing Sheets

ROOF JACK WITH BRACKET

BACKGROUND OF THE INVENTION

The present invention relates to jacks for lifting or supporting a roof of a building, to assemblies for securing such a jack between a roof truss and an underlying ceiling joist, and to methods for lifting and supporting a roof.

At times during construction, renovation, or repair of a building it may be necessary to further support or lift the roof. It has been suggested that roofs may be lifted by using a jack, wherein the jack extends from the slanted or angled roof truss to the ceiling joist below. In such circumstances, the base of the jack, which is at an acute angle to the ceiling joist, must be laterally supported. Typically, lateral support is provided by a block of wood which is nailed to the joist. The opposite end of the jack is conventionally not retained in position by any mounting structure, and is only held in position relative to the truss by the weight of the roof.

Since the base of the jack in the aforementioned prior art jacking method is at a sharp angle to the ceiling joist, there is a tendency for the jack to slide along the joist, despite the lateral support provided by the block of wood. Moreover, the lack of any mounting structure at the truss-end of the jack creates the possibility that the jack will slip off the truss during the lifting operation. These deficiencies cooperate to render roof jacking a difficult undertaking, and one which requires more than one person to perform correctly.

Therefore, there exists a need in the art for a device for mounting a jack to a roof truss and to a ceiling joist. There also exists a need for an improved method for lifting and supporting a roof.

SUMMARY OF THE INVENTION

The present invention is directed toward a mounting bracket which solves the problems encountered in the prior art. More specifically, a mounting bracket according to the present invention facilitates mounting of a jack between a roof truss and a ceiling joist and permits lifting and supporting a roof in accordance with the improved method of the present invention.

In accordance with a first preferred embodiment of the present invention, a roof jack mounting bracket includes first and second end sections and a main body section intermediate the end sections. The end sections preferably extend generally perpendicularly to the main body section and are generally parallel to one another.

In further accordance with the first embodiment of the present invention, a ramped mounting portion extends outwardly from, and at an angle to, the main body section. The mounting portion defines an opening which is adapted to receive a jack.

In accordance with a second preferred embodiment of the present invention, a mounting bracket includes planar, oppositely extending end sections and an intermediate mounting section. The mounting section includes a ramped mounting portion which defines an opening adapted to receive the jack.

The present invention also provides a method for lifting a roof including the steps of securing a first mounting bracket to a roof truss, securing a second mounting bracket to a ceiling joist, inserting one end of a jack into an opening in a mounting portion of the second mounting bracket, aligning a second end of the jack with an opening in a mounting portion of the first mounting bracket, operating the jack such that the second end of the jack extends into the opening in the mounting portion of the first mounting bracket, and further operating the jack to lift and support the roof truss.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
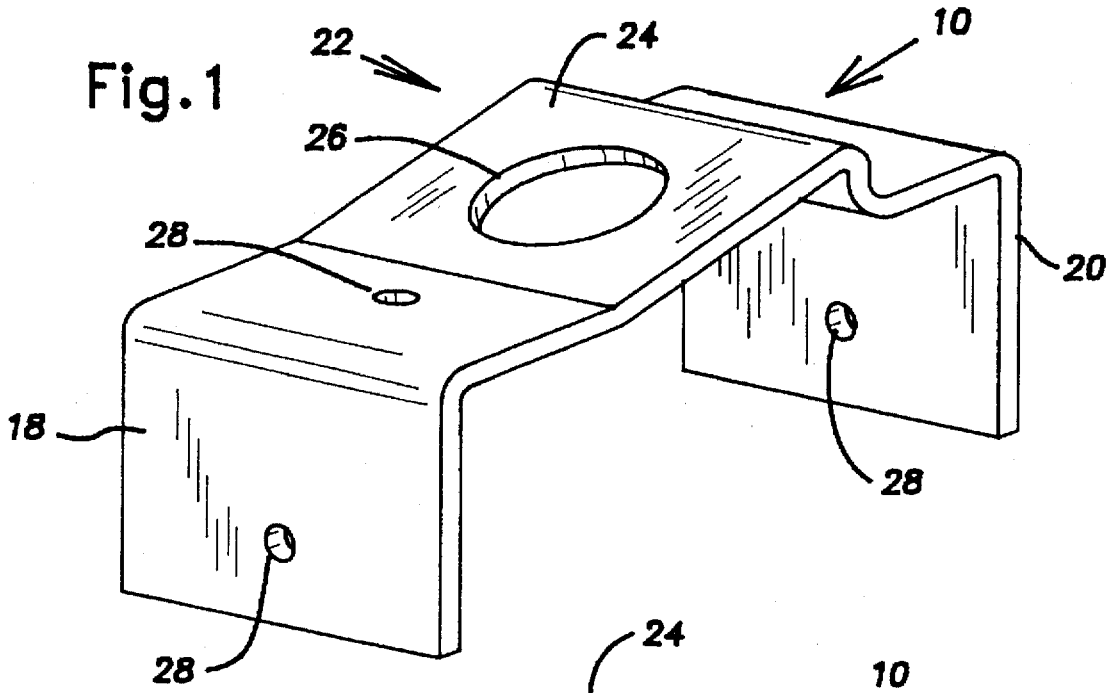
FIG. 1 is a perspective view of a mounting bracket according to a first embodiment of the present invention.
Figure 2:
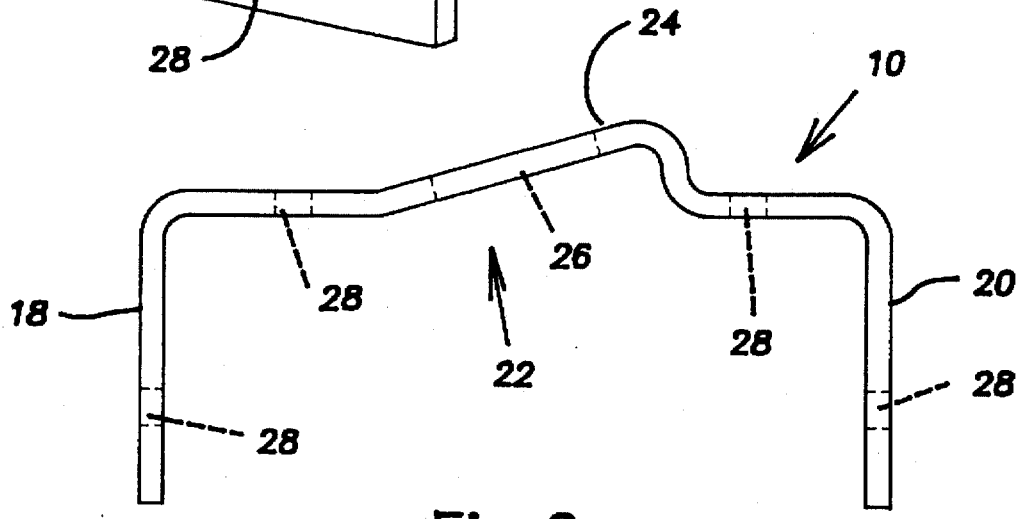
FIG. 2 is a front elevational view of the mounting bracket shown in FIG. 1.
Figure 3:
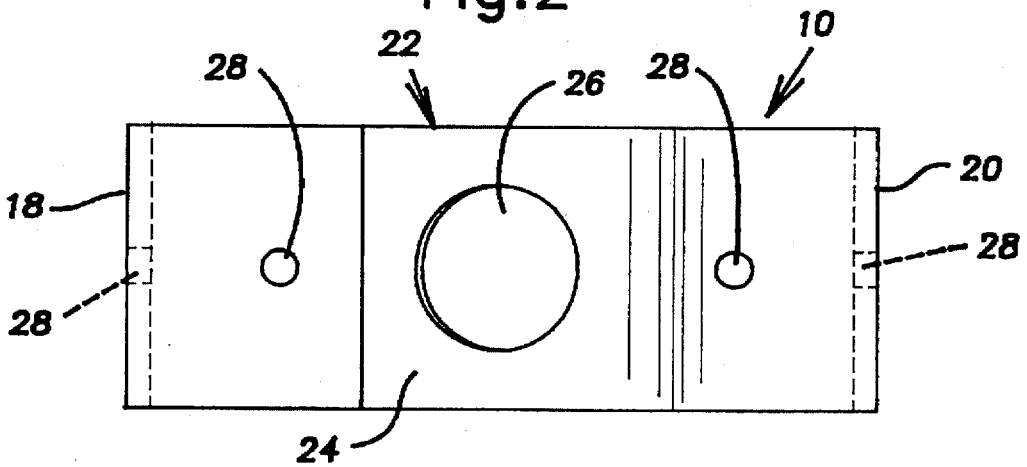
FIG. 3 is a top plan view of the mounting bracket shown in FIG. 2.

With reference to the FIGS. 1–3 and 7–8, a mounting bracket 10 according to a first embodiment of the present invention is used to secure a screw-type jack 12 between a roof truss 14 and a ceiling joist 16. The mounting bracket 10 is preferably formed or stamped from a single piece of metal such as sheet steel, and is generally U-shaped, having a pair of end sections 18, 20 which are parallel to each other and generally perpendicular to an intermediate main body section 22. The main body section 22 includes a ramped mounting portion 24 which receives and retains the jack 12. More specifically, the mounting portion 24 is an outwardly deformed, ramped mid-portion of the main body section 22, as illustrated best in FIGS. 1 and 2. An enlarged opening 26 is formed in the mounting portion 24 and receives an end of the jack 12, as shown best in FIG. 8.

The main body section 22 and each of the end sections 18, 20 includes a plurality of apertures 28 which allow the mounting bracket 10 to be attached to the truss 14 or joist 16 by means of conventional construction fasteners, such as nails (not shown). The end sections are adapted to be attached to lateral sides of a piece of lumber, while the main body section 22 is attached to a face of the lumber perpendicular to and between the lateral sides thereof.

Figure 4:
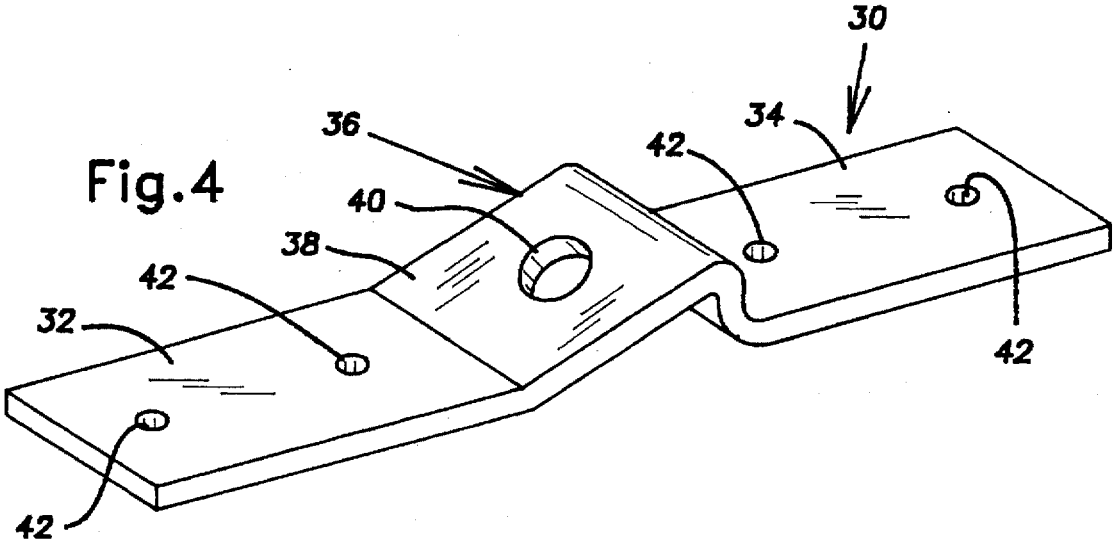
FIG. 4 is a perspective view of a mounting bracket according to a second embodiment of the present invention.
Figure 5:
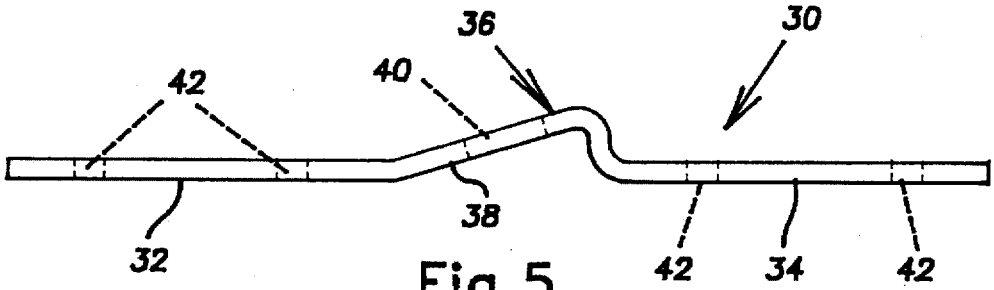
FIG. 5 is a front elevational view of the mounting bracket shown in FIG. 4.
Figure 6:
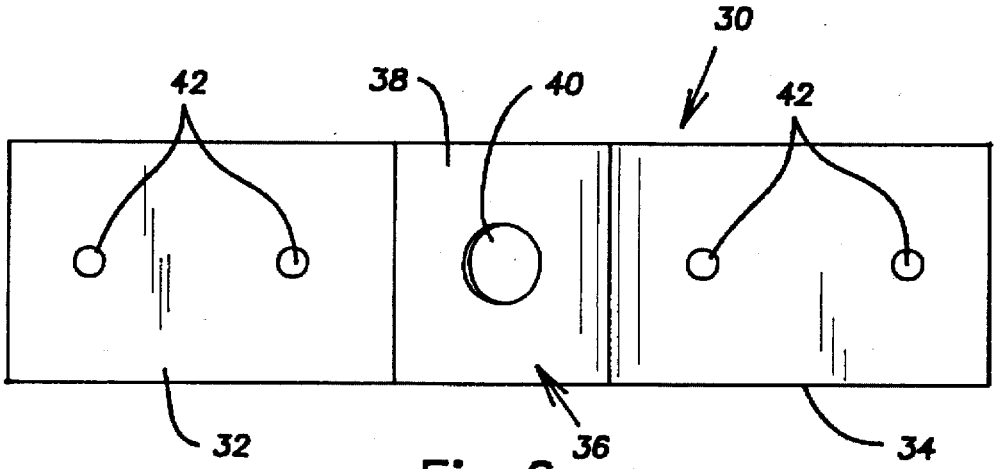
FIG. 6 is a top plan view of the mounting bracket shown in FIG. 5.

A second preferred embodiment of the mounting bracket 30 according to the present invention is shown in FIGS. 4–6, wherein the mounting bracket 30 is shown to include planar, oppositely extending end sections 32, 34 and an intermediate mounting section 36. The mounting section 36 includes a ramped mounting portion 38 which has an enlarged opening 40 therein for receipt of the jack 12. The ramped mounting portion is an outwardly deformed mid-portion of the mounting section 36, as illustrated. Each of the end sections 32, 34 includes a plurality of apertures 42 which allow the end sections 32, 34 to be attached to the truss 14 or joist 16 by means of conventional construction fasteners, such as nails (not shown).

Figures 7, 8:
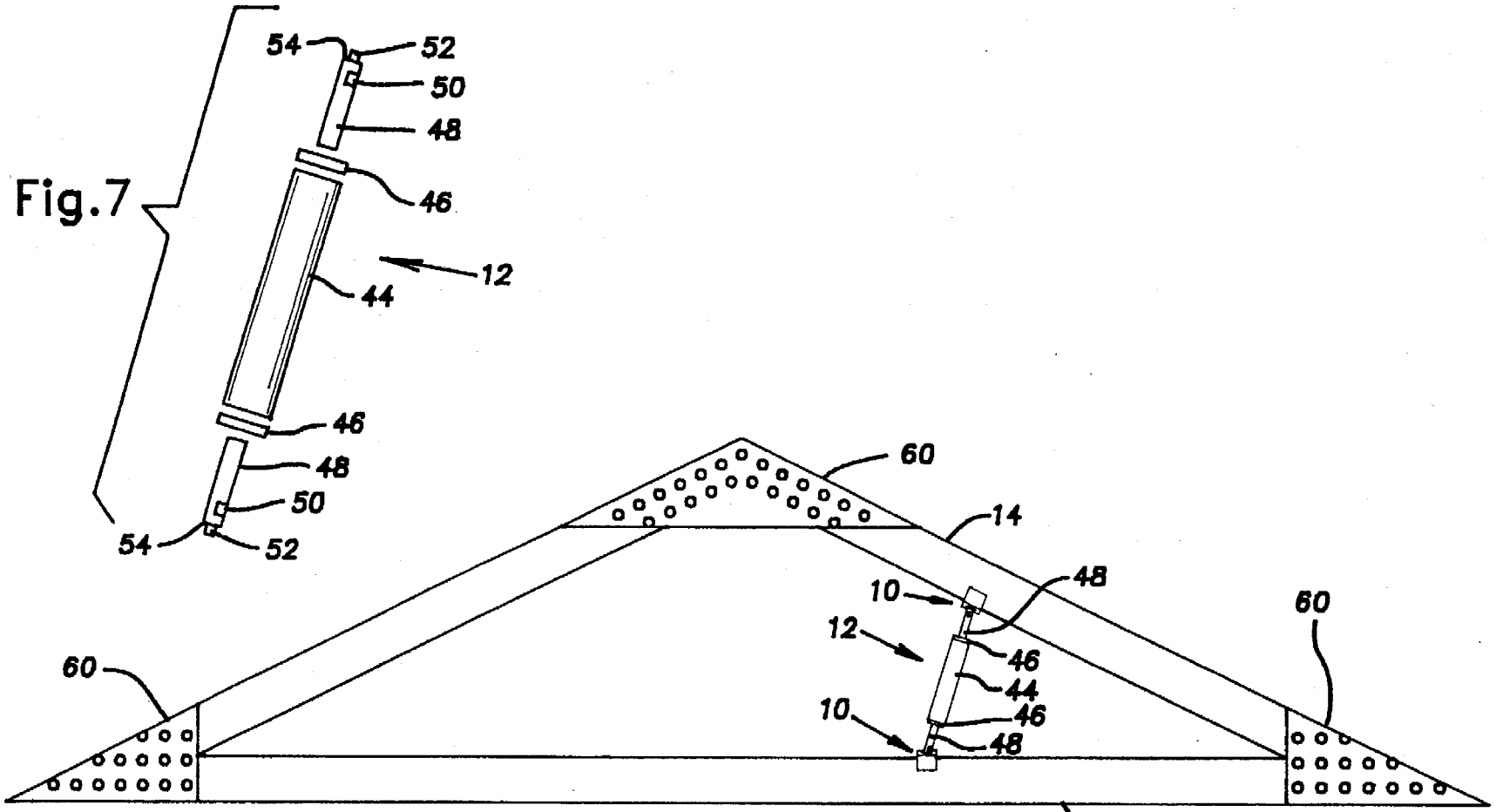
FIG. 7 is an exploded elevational view of a jack according to the present invention.
FIG. 8 is an elevational view showing the first embodiment of the mounting bracket and the jack used in lifting a roof.

With reference to FIG. 7, the jack 12 preferably includes a central tubular body 44 having a collar 46 fixed to each end thereof. An adjustment screw 48 is threadably secured to each collar 46 such that rotation of the tubular body 44 in one direction causes the adjustment screws 48 to extend while rotation of the tubular body 44 in the opposite direction causes the adjustment screws 48 to retract. A distal portion 50 of each adjustment screw 48 preferably includes a reduced diameter terminal end 52. The terminal end 52 is sized to extend through the enlarged openings 26, 40 in the mounting bracket 10, 30, while an annular surface 54 surrounding the reduced diameter terminal end 52 will engage the surface of the mounting portion 24, 38 surrounding the enlarged openings 26, 40.

The method of using the mounting brackets 10, 30 and the jack 12 to lift a roof will be discussed hereafter with regard to the first embodiment of the mounting brackets 10 and with specific reference to FIG. 8. It is to be understood that the second embodiment of mounting brackets 30 can be similarly used.

The mounting brackets 10 are attached to appropriate locations on the truss 14 and a downwardly adjacent joist 16. The location chosen for attachment of the mounting brackets 10 will depend upon where support is needed, and the length of the jack 12. It will be apparent to one skilled in the art that the lifting method of the present invention is useful in lifting and supporting roofs in both older and newer construction. For example, in older buildings the ceiling joists are typically nailed at each end to a lateral side of the roof truss and, as such, the lateral sides of the joists are horizontally displaced relative to the lateral sides of the trusses. However, newer buildings, as illustrated in FIG. 8, typically have corner plates 60 to join the trusses 14 to the joists 16 and, as such, the lateral sides of associated trusses and joists are generally co-planar.

Once the mounting brackets 10 are in place on the truss and joist, the lower, reduced diameter end 52 of the jack 12 is inserted into the enlarged opening 26 in the mounting bracket 10 on the ceiling joist 16, and the upper end of the jack 12 is aligned with the enlarged opening 26 in the mounting bracket 10 on the roof truss 14. The tubular body 44 of the jack 12 is rotated to extend the adjustment screws 48 and thereby insert the upper, reduced diameter end 52 of the jack 12 into the enlarged opening 26 in the truss mounting bracket 10. Thereafter, the tubular body 44 of the jack 12 is further rotated to lift and support the roof truss 14 the desired amount.

While the preferred embodiments of the present invention have been described and illustrated herein, it is contemplated that various modifications, rearrangements, and substitutions of parts may be resorted to without departing from the scope of the present invention as defined by the claims appended hereto. For example, it is contemplated that the mounting brackets 10 of the first embodiment may be used in pairs, or individually in combination with the mounting brackets 30 of the second embodiment.

What is claimed is:

1. A roof jacking system, comprising:

a pair of roof jack mounting brackets, each of said brackets including first and second end sections and a generally planar main body section intermediate said end sections, said end sections extending generally perpendicular to said main body section from opposite ends of said main body section and being generally parallel to and facing one another, wherein a mounting portion extends outwardly from, and at an angle to, said main body section, said mounting portion defining an opening having an axis which is at an acute angle to the main body section; and, a roof jack extending between said pair of roof jack mounting brackets, said roof jack having first and second ends which are adapted to fit within the openings in the mounting portions.

2. A roof jack mounting bracket according to claim 1, wherein each of said end sections include at least one aperture through which a mechanical fastener may extend to secure the bracket to an underlying piece of lumber.

3. A roof jack mounting bracket according to claim 2, wherein said main body section includes at least one aperture through which a mechanical fastener may extend to secure the bracket to the underlying piece of lumber.

4. A roof jacking system according to claim 1, wherein said mounting portion of each of said brackets angles outwardly from said main body section in a longitudinal direction from said first end section to said second end section.

5. A method of lifting a roof, comprising the steps of:

securing a first mounting bracket to a roof truss;

securing a second mounting bracket to a ceiling joist;

providing a jack for insertion between said mounting brackets, said jack having a lower end and an upper end;

inserting a lower end of the jack into an opening in the second mounting bracket;

aligning the upper end of the jack with an opening in the first mounting bracket;

operating the jack and thereby inserting the upper end of the jack into the opening in the first mounting bracket;

further operating the jack to lift the roof.

6. A method for lifting a roof according to claim 5, wherein the first mounting bracket is different than the second mounting bracket.

7. A method for lifting a roof according to claim 5, wherein the first and second mounting brackets are identical.

* * * * *